US012396514B2

(12) United States Patent
Fredouille

(10) Patent No.: US 12,396,514 B2
(45) Date of Patent: Aug. 26, 2025

(54) DEVICE FOR CONNECTING THE LOWER LEG OF A SKIER TO A SKI BINDING, AND FOOTWEAR ASSEMBLY INCORPORATING SAID DEVICE

(71) Applicant: HF CONSULTING, Lacanau (FR)

(72) Inventor: Hervé Damien Yves Fredouille, Lacanau (FR)

(73) Assignee: HF CONSULTING, Lacanau (FR)

( * ) Notice: Subject to any disclaimer, the term of this patent is extended or adjusted under 35 U.S.C. 154(b) by 0 days.

(21) Appl. No.: 17/918,785

(22) PCT Filed: Apr. 12, 2021

(86) PCT No.: PCT/EP2021/059420
§ 371 (c)(1),
(2) Date: Oct. 13, 2022

(87) PCT Pub. No.: WO2021/209376
PCT Pub. Date: Oct. 21, 2021

(65) Prior Publication Data

US 2023/0143847 A1 May 11, 2023

(30) Foreign Application Priority Data

Apr. 15, 2020 (FR) ..... 2003773
Apr. 15, 2020 (FR) ..... 2003775

(51) Int. Cl.
*A43B 5/04* (2006.01)

(52) U.S. Cl.
CPC ..... *A43B 5/0468* (2013.01)

(58) Field of Classification Search
CPC ... A43B 5/0468; A43B 5/0452; A43B 5/0454; A43B 5/0456; A43B 5/0423; A43B 5/0431; A43B 5/0429; A43B 5/04; A43B 5/046; A43B 5/0466; A63C 10/24
USPC ..... 36/117.1, 118.1
See application file for complete search history.

(56) References Cited

U.S. PATENT DOCUMENTS 3,747,235 A * 7/1973 Post ..... A43B 5/0454 36/118.4
3,931,982 A 1/1976 Kubelka
4,021,053 A 5/1977 Willi
4,420,895 A * 12/1983 Baumann ..... A43B 5/0431 36/118.2

(Continued)

FOREIGN PATENT DOCUMENTS

CA 2106373 A1 * 9/1992 ..... A43B 5/04
CA 2209836 C * 3/2001 ..... A43B 5/0464

(Continued)

OTHER PUBLICATIONS

International Search Report for corresponding PCT Application No. PCT/EP2021/059420 mailed Jun. 23, 2021.

*Primary Examiner* — Aiying Zhao
(74) *Attorney, Agent, or Firm* — Wood, Phillips, Katz, Clark & Mortimer

(57) ABSTRACT

Device for connecting the lower leg of a skier, with a foot and an ankle axis, to a ski binding mounted on a ski board, comprising a footwear assembly, a tibial connection with at least one rigid rod, where the at least one rigid rod comprises an upper end securely attached to the lower leg, and a lower end which is pivoting with respect to the footwear assembly.

10 Claims, 6 Drawing Sheets

(56) References Cited

U.S. PATENT DOCUMENTS

| | | | | | |
|---|---|---|---|---|---|
| 4,454,663 | A * | 6/1984 | Graillat | A43B 5/046 | 36/118.2 |
| 4,473,235 | A * | 9/1984 | Burt | A63C 9/00 | 36/118.8 |
| 4,539,764 | A * | 9/1985 | Pradier | A43B 5/0466 | 403/4 |
| 5,323,548 | A * | 6/1994 | Vogel | A43B 5/0456 | 36/118.4 |
| 6,691,434 | B1 | 2/2004 | Couturier | | |

FOREIGN PATENT DOCUMENTS

| | | | | | |
|---|---|---|---|---|---|
| EP | 0820789 | A1 | 1/1998 | | |
| EP | 1880623 | A1 * | 1/2008 | A43B 5/0456 | |
| FR | 2745988 | A1 | 9/1997 | | |
| WO | WO-9427455 | A1 * | 12/1994 | A43B 5/04 | |

* cited by examiner

PRIOR ART

DEVICE FOR CONNECTING THE LOWER LEG OF A SKIER TO A SKI BINDING, AND FOOTWEAR ASSEMBLY INCORPORATING SAID DEVICE

FIELD OF THE INVENTION

Background of the Invention

The invention relates to a device for connecting the lower leg of a skier with a ski binding. The invention also covers the footwear assembly integrating said device.

In the alpine field and more particularly the field of skiing and of ski boots, numerous constraints appear and often make the practice of skiing uncomfortable. In fact, the technology of ski boots has evolved very little over time and proposes only approximate foot comfort, while the practice requires improved comfort for the practitioners. Currently, ski boots are made of relatively rigid plastic and include two articulated rigid portions. The vertical portion of the ski boot receives a portion of the tibia and of the calf and the horizontal portion receives the actual foot. The amplitude of the bending of the ankle in such boots is very limited, a few degrees only. Adjustment means have been provided to adjust this amplitude, but over extremely limited ranges. In practice, there exist movements of the foot and movements of the boot which are different. In fact, for the comfort of the practitioner, comfort foams are interposed and therefore, depending on the clamping of the boot, depending on the type of foam, parasitic movements occur.

Moreover, despite the foam, shape-memory, self-molding, thermo-formable materials and other interfaces, comfort remains very limited, in addition to the costs of such materials. These intermediate materials are currently necessary because it is these linings which participate in thermal insulation. It is also understood that the forces exerted by the skier are not transmitted directly, except to constrain the boot very strongly with, as a corollary, total discomfort and difficulty in practice for several hours. Control is therefore poorly provided. Moreover, morphology is poorly taken into account, depending on whether the foot is narrow or broad, whether the kick is pronounced or the ankle is thin, prominent or not, and even materials for custom forming cannot compensate everything.

It is also noted that, the boots being enclosed in a rigid sealed shell, they generally constitute a sealed barrier against the outside and the outer snow or water, but this rigid sealed shell also constitutes a closed volume from which it is difficult to remove humidity generated by the phenomenon of natural perspiration of the foot. Another significant disadvantage is the weight of such boots with rigid shells, linked to the large volume of plastic to constitute the surrounding shell, to which is added the weight of the clamping members, of the foams. The aerodynamic properties of ski boots are currently penalized by the very large external volume of the boots due to the sock, the foam, the shell and the clamping members, which leads to adding the suits of competitors along the boot to attempt to minimize the impact of the volume of the boot on aerodynamic properties, or to add aerodynamic appendices for certain competitions or records.

One zone of the foot is particularly loaded mechanically, adjacent to the talus which is compressed during bending movements. During these forward movements, the upper part of the shell presses on the rod of the shell and exerts a large pressure. This is a true source of discomfort and of trauma. Likewise, pressure on the malleoli can grind flesh and cause local heating. Depending on the morphology of the skier, the profile of the boot, the pressures, the pressures during bending can also be concentrated at the top of the lower leg and cause a certain discomfort due to a concentration of forces.

A notable lack of flexibility in articulation between the two portions appears clearly, which induces a discomfort during forward/rearward movements inherent in practicing skiing. Besides the rigidity of this connection between the two portions, the flexibility of this connection is frozen by the individual characteristics of the boots such as geometry, the materials used, the non-adaptable arrangement of the boot. The characteristics of the plastics also vary with temperature during the day or depending on the seasons. Yet the need for retention and for flexibility, the need for bending can be very different depending on the discipline practiced, depending on the practitioners and their level of practice. Each of the two portions, considered independently, is equally uncomfortable for the foot as for the tibia portion of the lower leg.

It will also be noted, with current ski boots, that evolutions are not possible depending on the seasons; there is one pair of ski boots to ski with, whether the season is more or less hot or more or less cold. Only the boot lining can be changed, but its thickness remains identical because the geometry of the boot remains unchanged and unchangeable. The esthetic aspect is totally masked. Current solutions do not propose the possibility of evolving the practice of skiing by requiring a boot with more or less "flex," i.e. bending amplitude for example, depending on snow conditions, whether it is downhill skiing, in one or another specialty, or cross-country skiing.

It is also observed that the repair of such existing ski boots can only be carried out by professionals when one of the elements deteriorates. The possibility of replacing boots, of having them repaired rapidly, remains difficult. Also, taking the price into account, generally a skier has a single pair of boots. Moreover, modularity is impossible because if it is hotter at the beginning or end of the season, it is not possible to withdraw or to modify the boot lining even if it were removable, because the design of the boot includes a single type of lining, with one thickness and in a given material.

Solutions have been sought; it is thus that there exist walking boots which provide thermal insulation and sealing while the structural function is obtained by means of strips and levers, but these members are linked to each walking boot. In this case, the sensation is unsatisfactory because the foot retaining function is always parasitical due to the intermediate elements for thermal insulation and sealing of the boot.

Another solution consists of arranging a shell boot, for only the foot, and a lever with a band is linked in an articulated manner to said shell, and by its other end to the calf or at least to the lower leg by a band with clamping means. Mechanical abutments limit the bending amplitudes. This has a major disadvantage, which is that of the axis of rotation. In fact, for satisfactory comfort and movement, it is necessary that the axis of rotation between the boot and the rod be perfectly centered, boots to feet, on the malleoli of the practitioner. However, due to the morphology of each of us, even if the manufacturers perform calculations and tests, the results can only be based on the average of the results acquired. There is therefore a misalignment between the pivoting axis of the ankle and the pivoting axis of the rod with respect to the footwear shell, the great majority of the time. As a result, this misalignment necessarily causes geometrically a combined movement of translation and of rotation between the band and the calf, adjacent to the band, which be of greater or lesser amplitude, but in any case of an alternating and repetitive type, generating injuries at least, which handicap practice in the following days.

BRIEF SUMMARY OF THE INVENTION

The present invention proposes a device for connecting the lower leg of a skier with a ski binding, which seeks to replace the portion capable of receiving the tibia with a lighter and more comfortable system for retaining the tibia, eliminating the effects of misalignment adjacent to the ankle and the lack of parallelism between the tibia and the upper portion, while still responding to the different functions of connecting the body of the skier to the ski for better control during practice, for modulable thermal insulation and improved sealing, without inserted elements capable of interfering, while ensuring excellent ventilation of the foot with removal of the humidity produced.

The invention covers the footwear assembly equipped with the connecting device according to the present invention.

The present invention also proposes a footwear assembly which allows the skier to wear only one pair of boots, which avoids any constraint on the foot linked to wearing a shell, eliminating in particular the pressure on the talus and/or on the malleoli, which includes a high tibial connection to allow better control in practice, which allows modifications of the insulation depending on the season of practice, which ensures better comfort by very necessary ventilation, which can be equipped with a device for connecting the lower leg of a skier with a lighter and more comfortable ski binding, eliminating the effects of misalignment adjacent to the ankle and the lack of parallelism between the tibia and the upper portion while still responding to the different functions of connecting the body of the skier with the ski for better control during practice.

The present invention also allows solving numerous technical problems by increasing the comfort of the practitioner, by proposing a much lighter device and adaptability depending on the season, the skiing conditions, the type or the discipline of skiing practiced. The present invention allows rapid repairs without special tools, reduced manufacturing cost and a limited quantity of material.

To this end, the invention has as its object a device for connecting the lower leg of a skier, with a foot and an ankle axis, to a ski binding mounted on a ski board, comprising a footwear assembly, a tibial connection with at least one rigid rod, said at least one rigid rod comprising an upper end comprising means of attachment to the lower leg, including securing means and a lower end comprising a pivot connection pivoting about an axis with respect to said footwear assembly, characterized in that it comprises means of articulation having at least one degree of freedom, these means being interposed between the upper end of said at least one rigid rod and the means of attachment to the lower leg.

For example, the securing means can comprise a collar comprising at least one strip the ends of which are provided with self-gripping means.

According to one exemplary embodiment, the tibial connection can include two rigid rods, left and right. If necessary, the two rods, left and right, can be attached by their upper ends to the same means of attachment and each of the rigid rods can be articulated in its lower part around its own pivoting connection, right and left. As a variant, the tibial connection can include a rod with a semi-surrounding shape.

In a preferred example, the tibial connection can include a rigid semi-surrounding part provided, at its upper portion, with two lateral rods and at its lower portion, with two lateral straps. If desired, the straps can extend obliquely facing the lateral rods, and can in particular be connected by a transverse connecting part.

Advantageously, the means of articulation comprise a degree of freedom in translation. Preferably, the means of articulation can comprise a degree of freedom in translation and a degree of freedom in rotation.

Advantageously, the means of articulation comprise a mushroom-shaped pin with a body and a head, integral with the means for securing to the lower leg and comprising a longitudinal aperture provided at the upper end of the rigid rod, through which passes the body of said pin, this aperture having a width less than the diameter of the head, so that the body of said pin slides in this longitudinal aperture while the head of said pin retains said upper end of the rigid rod of the tibial connection.

As a variant, the means of articulation can include a flange in which the upper end of the rigid rod slides. If necessary, the flange can have a rectangular cross section and the end of the rigid rod can be rectangular and with smaller width and length than those of the flange.

The invention also has as its object a footwear assembly equipped with the connecting device according to the invention. The footwear assembly is characterized in that it comprises a base sole intended to receive a boot, said base sole including at least one substantially vertical lateral lug, the end of each lateral lug being intended to receive the pivot connection of each rigid rod.

Preferably, the base sole includes two lateral lugs, left and right. If necessary, the end of each lateral lug being intended to receive the pivot connection of each corresponding rigid rod, left or right. As a variant, the end of each lateral lug being intended to receive one of the pivot connections of the rigid rod with a semi-surrounding shape. If desired, one or some angular abutments, front and/or rear, can be positioned on the or each lateral lug.

According to one embodiment of the invention, the end of each lateral lug rises substantially adjacent to the axis of the ankle of the skier, so that the axis of the pivot connection is at least in proximity to the axis of rotation of the ankle. As a variant, each lateral lug can extend so that the axis of the pivot connection is substantially offset with respect to the axis of the ankle, for example by being positioned above the talus of the foot. In one example, each lateral lug can extend obliquely, and in particular toward the front of the base sole. As a variant, the end of each lateral lug rises vertically while being offset with respect to the axis of the ankle.

In a preferred example of the invention, the connecting device has a hinge connected fixedly to the straps of the tibial connection, for example by being mounted on the transverse connecting part. If necessary, each lateral lug is connected to said hinge to form a pivot connection.

For example, the base sole comprises, at the front and at the rear, ends respectively having a profile combined with that of the ski binding.

Advantageously, the lightweight boot comprises a rigid sole provided with a first portion of removable attachment means, the second portion of these removable attachment means being carried by the base sole. For example, the removable attachment means can comprise screws, snap or slide fasteners.

According to one example, the footwear assembly comprises at least one tubular-shaped sealed sleeve, with a shank, a lower opening, an upper opening and an opening for entry. The sealed sleeve is produced in particular from waterproof fabric. If desired, the lower opening can have a profile suited to the peripheral shape of the base sole and the upper opening can be linked to the means of attachment. A front or rear opening, for example of the slide fastener type, can be provided in the sealed sleeve, particularly along a longitudinal vertical line.

Advantageously, the footwear assembly comprises an insulating layer, as a lining attached by gluing or as a removable lining of the sealed sleeve, so as to provide thermal insulation.

According to one embodiment of the invention, the footwear assembly comprises a mechanical pump for ventilating the inside of the sleeve. Alternatively or cumulatively, perforations can be provided in the boot.

Advantageously, the footwear assembly comprises damping means, interposed between the base sole and at least one of the rigid rods of the connecting means. For example, the damping means can include a cylinder with a mechanical spring housed in two cylindrical half-bodies able to slide coaxially. As a variant, the damping means could include a gas cylinder, an oil cylinder, a mixed cylinder or a coupling of two cylinders.

Advantageously, the footwear assembly comprises means for adjusting the coincidence of the axis of the pivot connection with the axis of rotation of the ankle. For example, the adjusting means could be of the type with a single or double eccentric housed in a ring. As a variant, the adjusting means could comprise sets of apertures intersecting at 90°. If necessary, the footwear assembly can include means for locking the adjusting means in a given angular position. As a variant, the footwear assembly comprises means for adjusting the position of the axis of the pivot connection with respect to the axis of rotation of the ankle.

The invention also has as its object a footwear assembly equipped with a device for connecting the lower leg of a skier having an ankle with a pivoting axis and a ski binding mounted on a ski board, said footwear assembly comprising a base sole intended to receive a boot, said base sole including at least one substantially vertical lateral lug, the end of each lateral lug being intended to receive a pivot connection, defining an axis, at least one rigid rod mounted on said pivot connection by its lower end and provided at its upper end with means of attachment to the upper portion of the lower leg.

In one embodiment of the invention, the end of each lateral lug rises substantially adjacent to the axis of the ankle of the skier, so that the axis of the pivot connection is at least in proximity to the axis of rotation of the ankle. As a variant, each lateral lug can extend so that the axis of the pivot connection is substantially offset with respect to the axis of the ankle.

Advantageously, the base sole comprises at the front and at the rear, ends having a profile combined with that of the ski binding.

If desired, the lightweight boot comprises a rigid sole provided with a first portion of removable attachment means, the second portion of these removable attachment means being carried by the base sole.

Advantageously, the footwear assembly comprises at least one tubular-shaped sealed sleeve, with a shank, a lower opening, an upper opening and an opening for entry.

Advantageously, the footwear assembly comprises an insulating layer, with a lining attached by gluing or a removable lining of the sealed sleeve to as to provide thermal insulation.

According to one embodiment of the invention, the footwear assembly comprises a mechanical pump for ventilating the inside of the sleeve.

Advantageously, the footwear assembly comprises means of articulation interposed between the at least one rigid rod and the means of attachment.

Advantageously, the footwear assembly comprises damping means, interposed between the base sole and at least one of the rigid rods of the connecting means.

Preferably, the means of articulation comprises two degrees of freedom, one degree of freedom in translation and one degree of freedom in rotation.

Advantageously, the footwear assembly comprises means for adjusting the coincidence of the axis of the pivot connection with the axis of rotation of the ankle.

The present invention is now described by means of solely illustrative examples, limiting in no way the scope of the invention, and based on appended illustrations, in which:

DETAILED DESCRIPTION OF THE INVENTION

Figure 1:
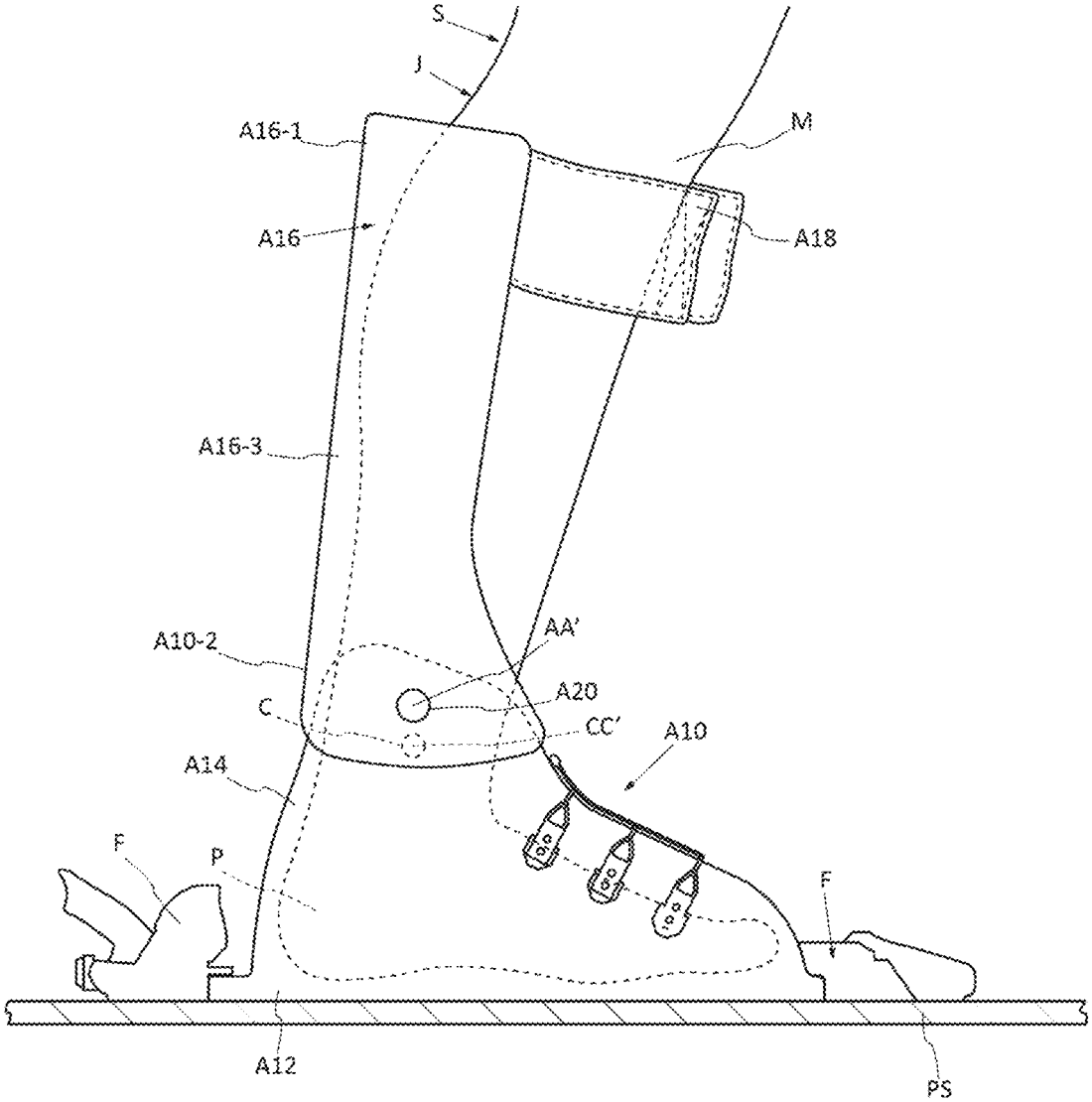
FIG. 1 shows a schematic view of the interaction between a ski footwear device with a tibial attachment of the prior art and the anatomy of the lower leg of a skier.

Shown in a simplified manner in FIG. 1 is the interaction between a footwear device A10 and the lower leg J of a skier S in an embodiment of the prior art. Thus the footwear device A10 of the prior art is attached in known fashion by its sole A12, integral with a shell A14 receiving the foot P, on a ski board PS, by means of a fastener F, this in a known manner. The footwear device A10 of a known type comprises a tibial connection A16. This tibial connection A16 consists of at least one rigid rod A16-3 which comprises, at its upper end A16-1, means of attachment A18 intended to be positioned on the lower portion of the calf M, above the ankle C of the skier S, and comprises, at its lower end A10-2, pivot connection means A20 with the shell A14. This tibial connection A16 can therefore pivot around an axis AA' and the tibia of the skier S can pivot with respect to the foot around an axis CC' which is the axis of the ankle C. It is noted that in the embodiment shown, a single semi-surrounding rigid rod is provided which is totally equivalent to two rods, right and left, connected together.

Depending on the anatomy of a skier S, necessarily different from one skier to another, even for an identical foot length, these axes AA' and CC' can only exceptionally be congruent. But during practice, the skier S is caused to continually modify his position with respect to the ski boards PS and his center of gravity, when bending and when inclining the tibia with a certain amplitude to shift his weight forward or rearward. Moreover, these variable inclinations in the front/rear plane occur during phases with positions of the body, therefore of the lower leg, more or less inclined laterally, which also continually modifies the pressures, the forces. There therefore exists a misalignment of the axes, which induces translation movements of the means of attachment A18 of the tibial connection A16 to the calf M at each bending movement. These movements are limited, but they are continuous and cause discomfort at the very least, an injury at worst, all the more so because the means of attachment A18 are clamped, but there is also a minimum clamping of said means of attachment A18 to retain good control of the skis.

Figure 2:
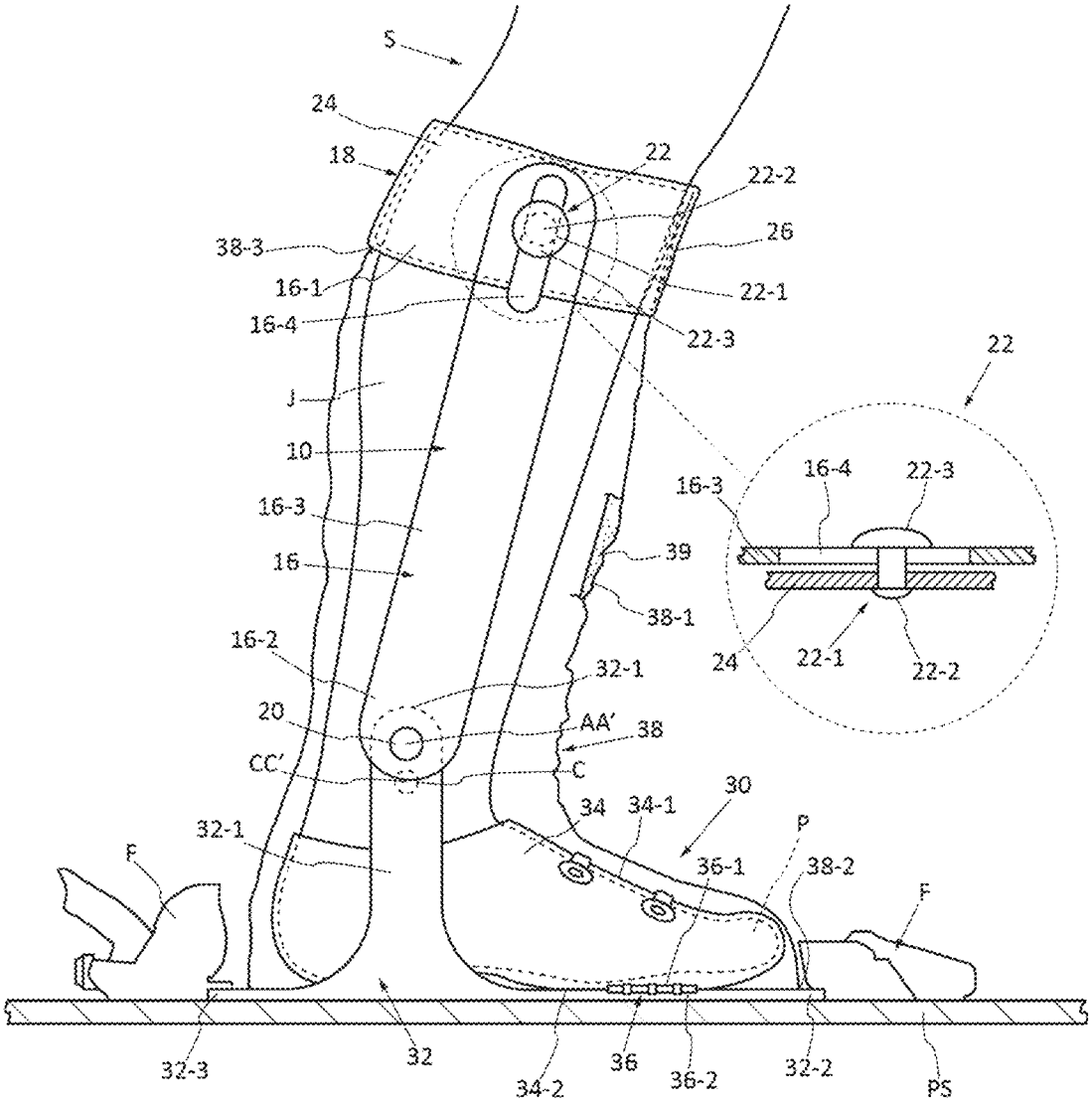
FIG. 2 shows a schematic view in lateral elevation of the device for connecting the lower leg with a ski binding according to the present invention.

The present invention is shown schematically in FIG. 2; clothing of the sock, pant, type has been eliminated for clarity of the representation. In this FIG. 2, common elements are found with those of the prior art, having the same labels but with the A eliminated. The device 10 for connecting the lower leg J of a skier S to a ski binding, according to the present invention, comprises a tibial connection 16 in the form of at least one rigid rod 16-3, the upper end 16-1 of which carries means 18 of attachment to the lower leg and the lower end 16-2 of which carries a pivot connection 20. The present invention relates in particular to these means of attachment 18 which comprise means of articulation 22, with at least one degree of freedom, in translation in the main and in translation and rotation in the better embodiment. This arrangement can therefore be adapted to existing shell boots with a tibial connection, simple boots with a tibial connection linked to said simple boot or even to the preferred embodiment of a footwear assembly with a sole as described below.

To this end, the means of attachment 18 comprise means 24 for securing to the lower leg J, for example in the form of a collar 26 of the type comprising at least one strip the ends of which are provided with self-gripping means. These self-gripping means allow adjustment of the clamping of the securing means by the skier S on the lower leg, this in known fashion. The tibial connection 16 comprises at least one rigid rod 16-3, right and left or semi-surrounding, each with an upper end 16-1. The means of articulation 22 are interposed between each upper end 16-1 of said at least one rigid rod 16-3 and the means of attachment 18. In this case, two rods are provided, right and left, but they could also form only one rigid rod with a semi-surrounding shape as already indicated.

According to a preferred embodiment, the means of articulation 22 comprise at least one degree of freedom selected among translation and rotation, translation being selected for the main one. For each at least one rigid rod 16-3, still according to a particular embodiment, these means of articulation 22 consist of a mushroom-shaped pin 22-1 with a body 22-2 and a head 22-3. The pin 22-1 is integral with the means 24 for securing to the lower leg J. The upper end 16-1 of the rigid rod 16-3 comprises the other portion of the means of articulation 22, namely a longitudinal aperture 16-4. This aperture has a width that is smaller than the diameter of the head, over at least a portion of its periphery. Thus, the body 22-2 of said pin 22-1 slides in this longitudinal aperture 16-4 while the head 22-3 of said pin retains said upper end 16-1 of the rigid rod 16-3 of said tibial connection 16. The upper end 16-1 of said tibial connection 16 can then pivot and move in translation with respect to the securing means 24, which are not loaded in any way with respect to the lower leg J.

As a matter of fact, the securing means 24 of the means of attachment 18 of the tibial connection can be placed higher on the lower leg J, i.e. below the knee, in the upper portion of the tibia, with no trouble. In the prior art, the higher the tibial connection was, the greater the movements of the means of attachment were with respect to the lower leg. This is no longer the case with the present invention, and the means of articulation 22 interposed between the at least one rigid rod 16-3 of the tibial connection 16 and the means of attachment 18 of said tibial connection 16 on the lower leg J allow positioning the securing means 24 between the lower portion of the lower leg J and the upper portion of the lower leg J, therefore preferably at the upper portion, this provided that the at least one rigid rod 16-3 is of suitable length. The advantage of positioning the securing means with the at least one rigid rod 16-3 with a great length is to procure for the skier S better control of his bending and of the movements of the foot P and to have smaller forces transmitted to the tibia for a given bending moment due to the increase in the length of the multiplying lever arm. Preferably, a rigid rod 16-3 is provided on each side of the lower leg J so as to dispose of, for each shell 14, two rigid rods, right and left, attached to the same means of attachment 18 and therefore to the same securing means 24, including when a single semi-surrounding rod is involved. Means of articulation 22, other than a pin in a slide, can be considered, including a simple flange in which the upper end of the corresponding rigid rod slides. The flange then having a rectangular cross section and the end of the rod also being rectangular but with a slightly smaller width and with a sufficiently smaller length, the clearance is sufficient to allow translation and a given angular rotation. It is observed that the problem of continuous movements and loading of the means of attachment 18 is solved and that even if the axes CC' and AA' are not aligned, the offset is compensated by the means of articulation 22, contributing all the comfort on this portion of the connection device.

It is also observed that, when the means of articulation comprise two degrees of freedom, hence translation and rotation, the pressure on the pin 22-1, in this case, is exerted on the set of securing means because the pin exerts its force radially, so that the force is distributed over the entire surface of the securing means in a homogeneous manner and not a pointwise force which acts in an unbalanced fashion on the top or on the bottom of the securing means in the arrangements of the prior art. This also leads to the improvement of comfort due to this distribution of forces.

It is understood that the connecting device 10 according to the present invention finds application to shells with a tibial connection of the prior art, to boots with tibial connection and to the footwear assembly described hereafter.

The numerous problems connected to the presence of a shell with the weight, the constraints on the talus, on the malleolus, constraints linked to the clamping of the shell, the confining of the foot with impermeability to the removal of perspiration, in particular, are however not solved by the connection device according to the present invention. The connecting device according to the present invention being able to be installed with means of articulation 22, the present invention proposes a footwear assembly equipped or not with said connecting device 10, which solves the problems invoked above and not solved by the connecting device.

In this same FIG. 2, in the lower portion, a footwear assembly 30 according to the present invention is described which integrates the device 10 for connecting the lower leg J to a ski binding F. The invention also covers the footwear assembly integrating said device 10 for connecting the lower leg J with a ski binding F, the footwear assembly eliminating the shell A14 of the prior art. Thus, the footwear assembly 30 comprises a base sole 32 intended to receive a boot 34. This base sole 32 includes at least one substantially vertical lateral lug 32-1, the end of each lateral lug 32-1 being intended to receive the pivot connection 20 of each rigid rod 16-3. The end of each lateral lug 32-1 rises substantially adjacent to the axis CC' of the ankle of the skier S, having worn it, so that the axis AA' is congruent with or at least in proximity to the axis CC'. This base sole 32 comprises, at the front and at the rear, ends 32-2 and 32-3 respectively, having a profile combined with that of the ski binding F that receives it.

According to the invention, in the footwear assembly 30 of the present invention, the foot P is housed in a lightweight boot 34, itself comprising a rod 34-1 surrounding the foot, using leather for comfort for example and a rigid sole 34-2. The rigid sole 34-2 is advantageously a sole with high stiffness, like the soles of bicycling shoes for automatic pedals. This rigid sole 34-2 includes a first portion 36-1 of removable attachment means 36, of which the second portion 36-2 of these removable attachment means 36 is carried by the base sole. The lightweight boot 34 can therefore be attached removably to the base sole 32. The removable attachment means 36 can be screws, snap or slide fasteners or any similar means, at the front and at the rear of the sole. The foot P is retained in the lightweight boot by any known means for closing the upper, such as laces, wire micrometric closures or hook closures.

The footwear assembly 30 thus comprises a base sole 32 including, in the preferred embodiment, two lateral lugs 32-1, right and left, a tibial connection 16 with two rigid rods 16-3, right and left, connected together or being a single monolithic rigid rod with a semi-surrounding shape. Each rigid rod 16-3 is articulated at its lower portion 16-2 around its own pivot connection 20, right and left, defining the axis AA'. Each rigid rod 16-3 is connected by its upper end 16-1, right and left, to the means of attachment 18 and more particularly to the means of articulation 22 of the means 24 for securing said means of attachment 18 to the lower leg J.

The present footwear assembly 30 is completed by at least one tubular-shaped sealed sleeve 38, with a shank 38-1, a lower opening 38-2 and an upper opening 38-3. The material used is preferably a waterproof fabric. The shank 38-1 can be produced to shape, i.e. to the profile of the lightweight boot and the lower leg J. The lower opening 38-2 has a profile suited to the peripheral shape of the base sole 32 in order to be able to provide a sealed mechanical connection between said lower opening 38-2 and said base sole 32. The high opening 38-3 can be linked to the means of attachment 18, particularly to the securing means 24. An opening for entry, for example a rear opening of the slide fastener type, can be provided, more particularly along a longitudinal vertical line. This slide fastener can advantageously be sealed. An opening on the front is also possible.

The present footwear assembly can also be equipped with an insulating layer 39, shown very partially in FIG. 2, which can be a lining, attached by gluing or removable, of the sealed sleeve 38, or a separate complete sleeve. This insulating layer 39 provides thermal insulation.

In order to be able to ventilate the inside of the sealed sleeve and allow the feet to breathe, perforations are preferably provided in the lightweight boot. Natural ventilation within the sealed sleeve 38 provides circulation, on the one hand because said sealed sleeve remains flexible and a circulation space is provided and, on the other hand because during permanent bending movements there occurs a continuous suction/blowing effect. If necessary, other options can be considered, particularly if the sleeve is tight, waterproof and insulating as a neoprene material would be; it would then be necessary to be able to ventilate the interior and a mechanical pump can be installed, such as a ball with a valve which blows air inward drawn from the outside, driving out humid air, this during each bending movement which are continuous during practice. Any solution remains conceivable, particularly technical materials, simultaneously waterproof and breathable.

The skier therefore wears a lightweight boot applied and integral with the base sole 32. The means 18 of attachment to the lower leg J, integral with said base sole in its lower portion, articulated due to the pivot connections 20 in the lower portion, provide the control of the base sole 32, this sheltered from humidity and exterior cold. The forces are thus exerted on the base sole 32 and not on the sides of the boot when the rigid rods are applied to it. Bending can be limited angularly in particular by the stroke of the means of articulation 22, so that the angular abutments, front and rear, can be positioned on the lugs for example. The selection of the stroke is linked to physiological possibilities and to agreement with practice. This allows improving the control of the ski by the skier.

Figure 3:
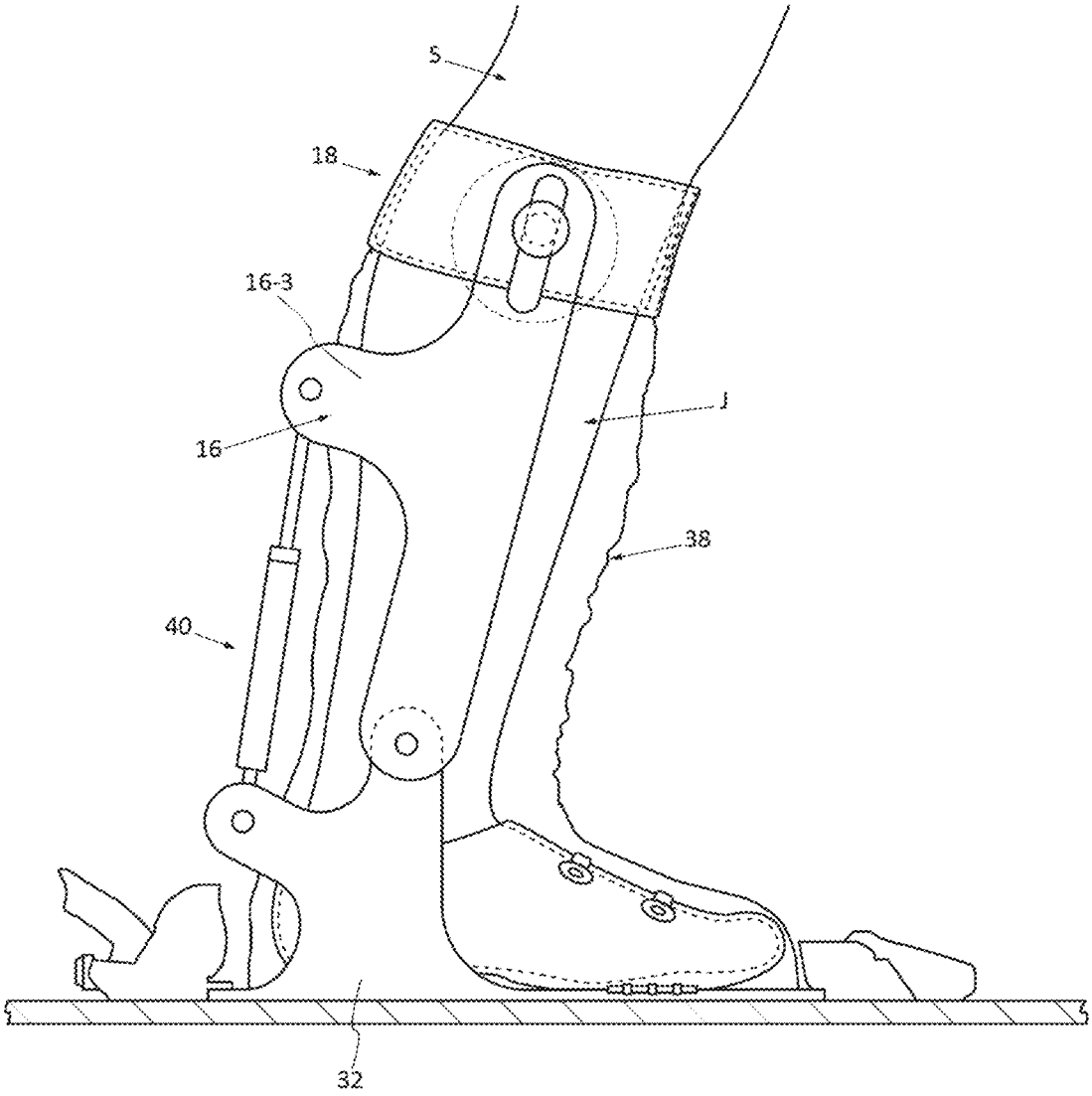
FIG. 3 shows a schematic view in lateral elevation of the device for connecting the lower leg with a ski binding according to the present invention, and its damping means.

According to an improvement, see FIG. 3, it is also possible to provide an improvement of the control of the skis due to damping means 40, interposed between the base sole 32 and at least one of the rigid rods 16-3 of the connecting means 16. Damping means 40 of this type can take on any form, particularly that of a cylinder with a mechanical spring housed in two cylindrical half-bodies capable of sliding coaxially, but can also be more sophisticated such as a gas cylinder, an oil cylinder, a mixed cylinder or a coupling of two cylinders. The forces are large due to the fact that lever arms are involved. Dampers of this type allow further improvement in the control of the skis by the skier during practice, and particularly during descent. The damping means can also be de-clutched during prolonged stops during downhill skiing or during climbing with cross-country skis. During descent, in both disciplines, the damping means are in service for good control. De-clutching takes place without tools. According to a particular arrangement, the damping cylinder could also be placed on the front. Likewise, instead of two rigid rods, right and left, a single semi-surrounding rigid rod would be completely equivalent, and this rigid semi-surrounding rod could be applied at the front and not at the rear.

Figure 4:
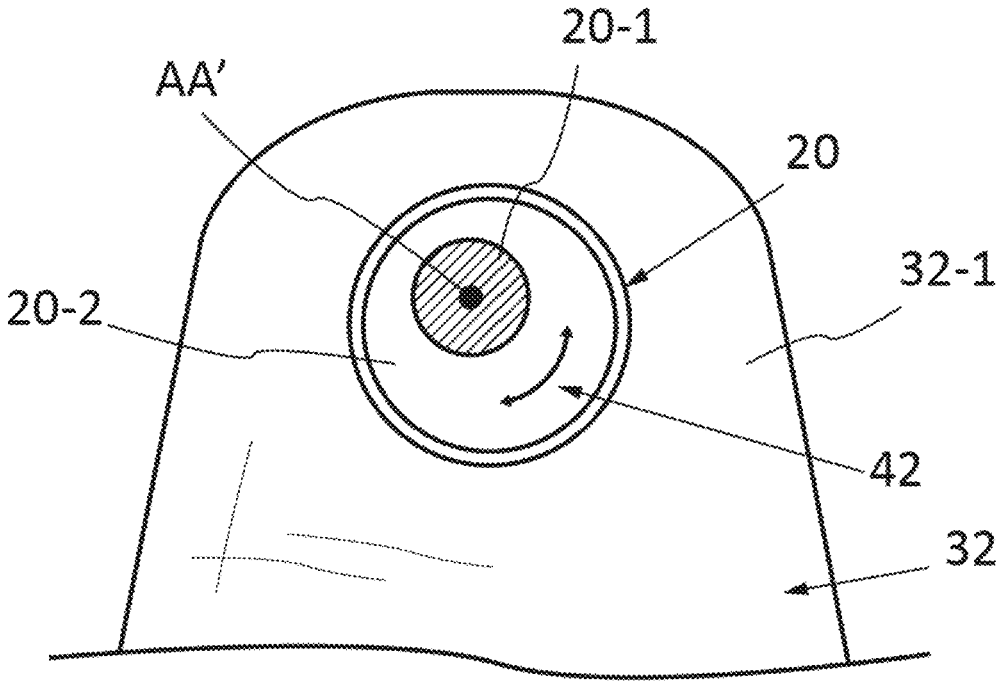
FIG. 4 shows a of a first variant of the means for causing coincidence.

According to an improved embodiment, it is also possible to adjust the coincidence of the axis AA' with the axis of rotation of the ankle CC' using means 42 for adjusting the coincidence of the axis AA' with the axis of rotation of the ankle CC'. To this end, the axis 20-1 of the pivot connection 20 is mounted on means for adjusting coincidence 42 of the type with an eccentric 20-2, see FIG. 4. If an adjustment is desired to ensure an even more perfect coincidence, an assembly with a double eccentric allows an adjustment in the plane. Thus, by turning the eccentric in its ring, it is already possible to adjust the position of the axis 20-1 of the pivot connection, which further improves comfort by virtually eliminating the movements of the means of articulation 22 by coincidence of the axes AA' and CC'. As a result, the means of articulation 22 could be installed with very limited amplitudes in the footwear assembly 30 according to the present invention. It should be noted that, in this case, the footwear assembly 30 of the present invention makes it possible to retain free visual access and contact with the ankle, and therefore to be able to provide adjustment in an optimized fashion with respect to the morphology of the skier, to arrive at a virtually perfect coincidence, especially with a double eccentric. Once the adjustment is carried out, locking means ensure the retention of the eccentric or of the double eccentric in the determined angular position.

Figure 5:
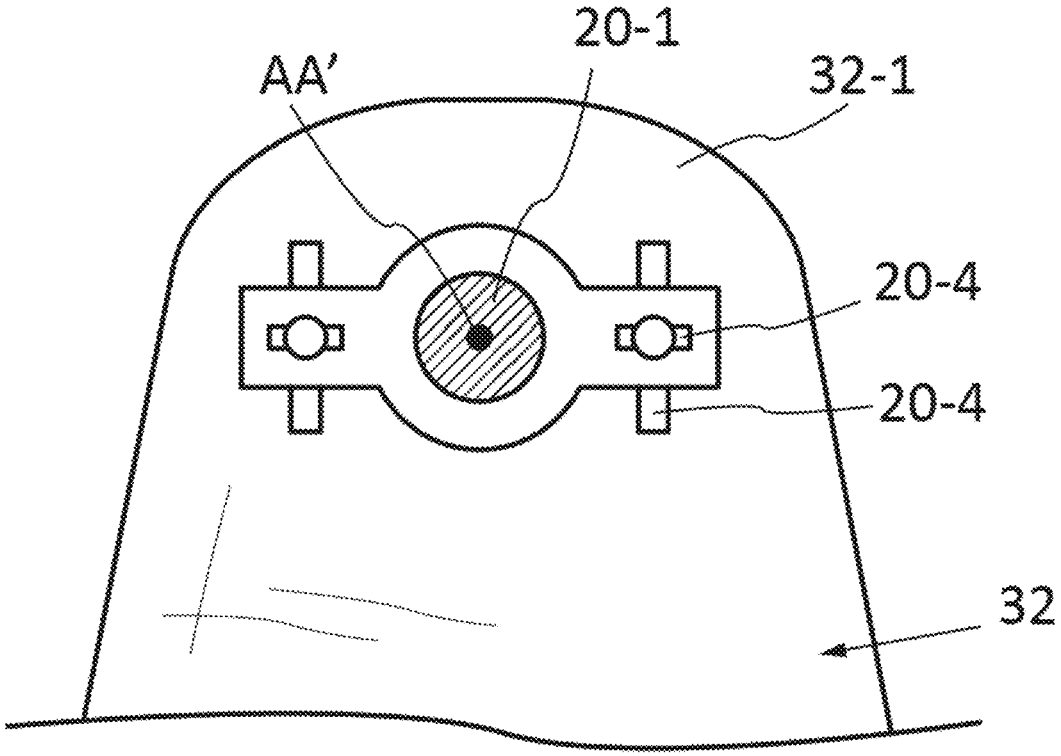
FIG. 5 shows a view of a second variant of the means for causing coincidence.

One variant of the means 42 for adjusting coincidence of the axis AA' with the rotation axis of the ankle CC' can be seen in FIG. 5. This variant, comprising apertures 20-4 intersecting at 90°, is another adjustment possibility. In this case, a plate 20-5 carries the axis 20-1 of the pivot connection and a set of apertures 20-4, and the lug 32-1 carries another set of apertures 20-4 intersecting at 90°, allowing adjustment of the position of the axis 20-1 of said pivot connection 20 to obtain the desired coincidence. This arrangement corresponds to the possibilities of movement of the double eccentric of the preceding variant, without these arrangements being limiting.

Figure 6:
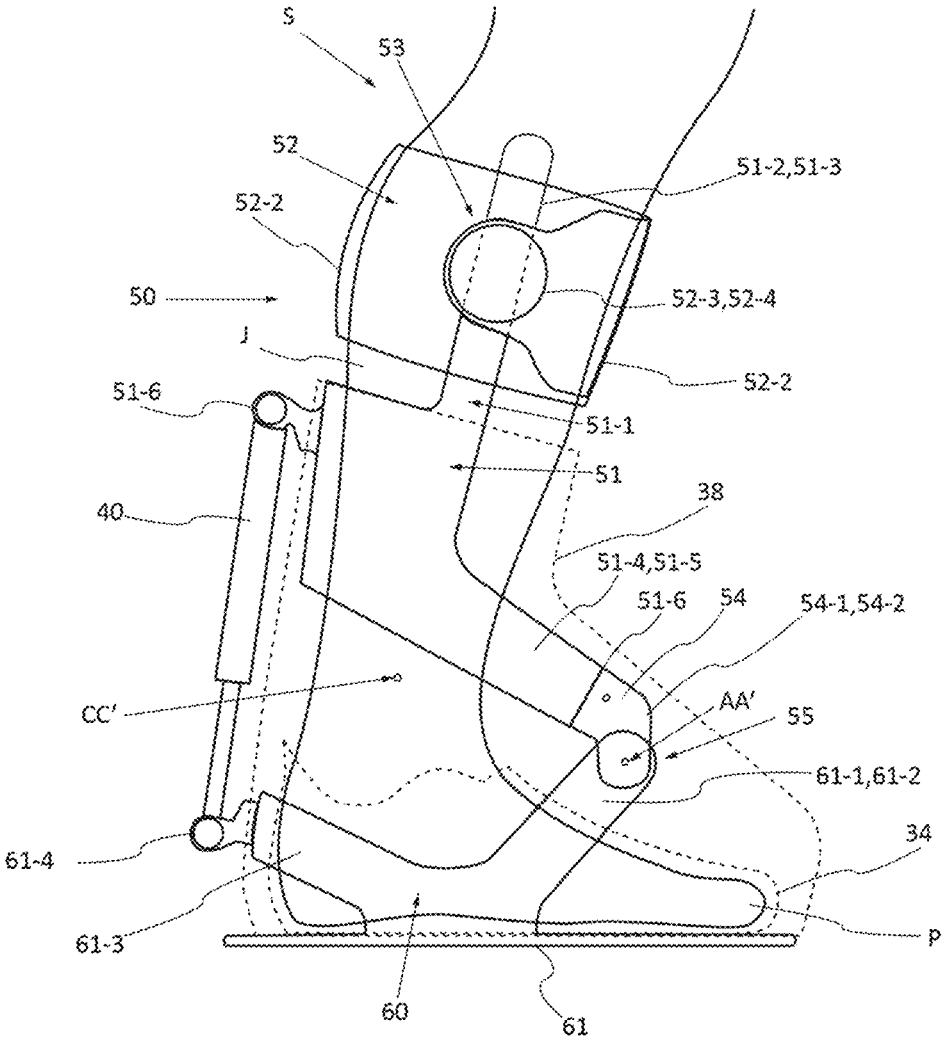
FIG. 6 shows a schematic view in lateral elevation of the device for connecting the lower leg with a ski binding according to another embodiment of the present invention.

Described in FIG. 6 is a device 50 for connecting the lower leg J of a skier S to a ski binding and a footwear assembly 60 according to another embodiment of the invention.

The connecting device 50 comprises a tibial connection 51 comprising a rigid semi-surrounding part 51-1 intended to surround the rear of the calf of the skier and provided, at its upper portion, with two rods, left and right, 51-2, 51-3, intended to be applied on either side of the calf, and at its lower portion, with two straps, left and right, 51-4 and 51-5 connected together by a transverse connection 51-6 intended to be applied above the foot of the skier.

The connecting device 50 includes means 52 of attachment to the lower leg including, on the one hand, securing means 52-1 intended to be fixed isostatically to the leg of the skier. For example, the securing means 52-1 can comprise at least one elastic band or a Velcro system allowing ensuring this isostatic condition. The means of attachment 52 include, on the other hand, a semi-surrounding part 52-2 intended to surround the front of the tibia of the skier, to which the securing means 52-1 are attached. Two flanges, left and right, 52-3 and 52-4, are applied to the lateral ends of this part 52-2. A slot is provided in each flange, left and right, 52-3 and 52-4, the upper end of the left, respectively right rod, 51-2, 51-3 sliding in this slot. The width of the slot of each of the flanges 52-3, 52-4 is greater than that of the rod 51-2, 51-3 which slides there, so that each pair of flange and rod forms a means 53 of articulating the means of attachment 52 with respect to the tibial connection 51, which comprises a degree of freedom in translation and a degree of freedom in rotation. The securing means 52-1 being isostatic with respect to the leg, the tibial connection 51 and the connecting device 50 are also isostatic with respect to the leg. The means of articulation 53 transmits only forces perpendicular to the tibia, due to the fact of the free translation of the means of attachment 52 in a direction parallel to the tibia, which are distributed homogeneously on the leg, due to the free rotation of the means of attachment 52 with respect to the tibial connection 51. It would be possible to provide, as a variant, for replacing each flange with a slide in which a rail mounted on the corresponding rigid rod slides, the slide and the rail then forming a means of articulation comprising only one degree of freedom in translation.

The footwear assembly 60 includes a base sole 61, from which extend two lateral lugs, left and right, 61-1 and 61-2. In the example described, the lugs 61-1, 61-2 extend from a substantially central point of the base sole 61, obliquely and toward the front of the base sole. It would be possible, as a variant, to consider that the lugs 61-1, 61-2 extend vertically from an eccentric point of the base sole 61.

A loop 61-3 extends rearward from the base sole 61, so as to be able to surround the heel of the skier. In the example described, the lateral ends of the loop 61-3 and the lower ends of the lugs 61-1, 61-2 are congruent.

The connecting device 50 includes a hinge 54, mounted on the transverse connection 51-6, and having two lateral tabs, left and right, 54-1 and 54-2. Each tab 54-1, 54-2 is thus connected to one of the lugs 61-1, 61-2 to form a pivot connection 55 of the tibial connection 51 with respect to the base sole 61, the pivot connection 55 thus defining an axis AA'.

As in the example of FIG. 3, the footwear assembly 60 can include damping means 40 interposed between the tibial connection 51 and the base sole 61. In the example of FIG. 6, a first hinge 51-6 is mounted on the part 51-1 and a second hinge 61-4 is mounted on the loop 61-3, the damping means 40 comprising a cylinder with a spring in which the cylinder and the piston are both connected to one of these hinges 61-6 and 61-4.

It is thus observed that, due to the orientation of the straps 51-4, 51-5 and of the lugs 61-1, 61-2, the axis AA' is substantially offset with respect to the axis of rotation CC' of the ankle of the skier, by being positioned above the talus of the foot of the skier. This geometry allows ensuring a distribution of the stress points, defined by the means of articulation 53, the pivot connections 55, and the two hinges 51-6 and 64-4, relatively balanced around the axis of rotation CC', the lever arms of each of these stress points thus being of the same order of magnitude and the forces at these points consequently being homogeneous.

It is thus observed that the invention allows dissociating the mechanical, thermal insulation and sealing functions by distributing them over different elements, each dedicated to one or more of these functions. While these functions are generally all provided by the assembly of the rigid shell and the foam of a conventional ski boot, which poses the problems mentioned in the preamble of the description, the invention proposes to attribute the mechanical function to the connecting device alone and to attribute the thermal insulation and sealing function to the sleeve, and thus specifically treat each of these functions without impacting or interfering with the others.

The representations of the connecting device and of the footwear assembly remain schematic, but could be modified esthetically and aerodynamically without departing from the scope of the present invention. It is observed that the width of the device is greatly reduced compared to shells.

What is claimed is:

1. A device for connecting a lower leg (J) of a skier(S), with a foot (P) and an ankle axis (CC'), to a ski binding (F) mounted on a ski board (PS), comprising:

a tibial connection (16, 51) with at least one rigid rod (16-3, 51-2, 51-3), said at least one rigid rod comprising an upper end (16-1) including means of attachment (18, 52) to the lower leg (J), said upper end including securing means (24, 52-1) and said at least one rigid rod comprising a lower end (16-2) including a pivot connection (20, 55) along an axis (AA') with respect to a footwear assembly, characterized in that the device includes means of articulation (22, 53) having at least one degree of freedom, the means of articulation being interposed between the upper end (16-1) of said at least one rigid rod (16-3, 51-2, 51-3) and the means of attachment (18, 52) to the lower leg (J), wherein the means of articulation (22, 53) comprise a degree of freedom in translation which persists when the skier is skiing.

2. The device for connecting the lower leg (J) of a skier(S) and a ski binding (F) mounted on a ski board (PS), according to claim 1, characterized in that the means of articulation (22, 53) comprise a degree of freedom in translation and a degree of freedom in rotation.

3. The device for connecting the lower leg (J) of a skier(S) and a ski binding (F) mounted on a ski board (PS), according to claim 1, characterized in that the means of articulation (22) comprise a mushroom-shaped pin (22-1) with a body (22-2) and a head (22-3), integral with the securing means (24) to the lower leg J and comprise a longitudinal aperture (16-4) provided at the upper end (16-1) of the rigid rod (16-3), through which the body of said pin passes, this aperture having a width less than a diameter of the head, so that the body (22-2) of said pin (22-1) slides in this longitudinal aperture (16-4) while the head (22-3) of said pin retains said upper end (16-1) of the rigid rod (16-3) of said tibial connection (16).

4. A footwear assembly (30, 60) equipped with the device (10) for connecting the lower leg (J) of a skier(S) and a ski binding (F) mounted on a ski board (PS), according to claim 1, characterized in that the footwear assembly comprises:

a base sole (32, 61) intended to receive a boot (34), said base sole (32, 61) including at least one substantially vertical lateral lug (32-1, 61-1, 61-2), an end of each of the at least one lateral lug (32-1, 61-1, 61-2) being intended to receive the pivot connection (20, 55) of each of the at least one rigid rod (16-3, 51-2, 51-3).

5. The footwear assembly (30) according to claim 4, characterized in that, when in use, the end of each lateral lug (32-1) rises substantially adjacent to the axis (CC') of the ankle of the skier(S), so that the axis (AA') is at least in proximity to the axis (CC').

6. The footwear assembly (60) according to claim 4, characterized in that each lateral lug (61-1, 61-2) extends so that the axis (AA') is substantially offset with respect to the ankle axis (CC') when in use.

7. The footwear assembly (30, 60) according to claim 4, characterized in that the base sole (32, 61) comprises ends at a front (32-2) and a rear (32-3), wherein the ends at a front and a rear of the base sole each have a profile combined with that of the ski binding (F).

8. The footwear assembly (30, 60) according to claim 4, characterized in that the footwear assembly further comprises the boot (34) which comprises a rigid sole (34-2) provided with a first portion (36-1) of removable attachment means (36), the second portion (36-2) of these removable attachment means (36) being carried by the base sole (32, 61).

9. The footwear assembly (30, 60) according to claim 4, characterized in that it comprises at least one tubular-shaped sealed sleeve (38) with a shank (38-1) made of a waterproof material, said shank having a lower opening (38-2) able to provide a sealed mechanical connection with said base sole, an upper opening (38-3) able to be linked to the securing means, and an opening for putting on the footwear assembly.

10. The footwear assembly (30) according to claim 4, characterized in that it comprises means of adjusting a coincidence (42) of the axis with respect to said footwear assembly (AA') with the ankle axis (CC') when in use.

* * * * *